US006556098B2

(12) United States Patent
Inami

(10) Patent No.: US 6,556,098 B2
(45) Date of Patent: Apr. 29, 2003

(54) NONRECIPROCAL CIRCUIT DEVICE WITH TAPERED SIDE WALL GUIDE PORTIONS IN THE RESIN CASE

(75) Inventor: Ryohei Inami, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/798,759

(22) Filed: Mar. 2, 2001

(65) Prior Publication Data

US 2002/0030551 A1 Mar. 14, 2002

(30) Foreign Application Priority Data

Mar. 3, 2000 (JP) ..... 2000-058574

(51) Int. Cl.[7] ..... H01P 1/383; H01P 1/36
(52) U.S. Cl. ..... 333/24.2; 333/1.1
(58) Field of Search ..... 333/1.1, 24.2

(56) References Cited

U.S. PATENT DOCUMENTS

| | | | | |
|---|---|---|---|---|
| 3,900,239 A | | 8/1975 | Anhalt et al. | 339/17 CF |
| 5,068,629 A | * | 11/1991 | Nishikawa et al. | 333/1.1 |
| 5,446,960 A | | 9/1995 | Isaacs et al. | 29/834 |
| 6,060,958 A | * | 5/2000 | Tokudera et al. | 333/1.1 |

FOREIGN PATENT DOCUMENTS

| | | | | |
|---|---|---|---|---|
| EP | 0903801 A2 | | 3/1999 | H01P/1/387 |
| EP | 0903801 A3 | | 9/2000 | H01P/1/387 |
| JP | 9-046104 A | | 2/1997 | H01P/1/383 |
| JP | 11-055009 A | | 2/1999 | H01P/1/383 |
| JP | 11-168305 A | * | 6/1999 | H01P/1/383 |

* cited by examiner

*Primary Examiner*—Justin P. Bettendorf
(74) *Attorney, Agent, or Firm*—Keating & Bennett, LLP

(57) ABSTRACT

The present invention provides a nonreciprocal circuit device which can be assembled by an automatic assembling machine, and in which the built-in components thereof can be disposed with a high positioning accuracy, and further provides a communication apparatus using this nonreciprocal circuit device. The nonreciprocal circuit device as an isolator includes a metallic lower case portion, a resin terminal case, a center electrode assembly, a metallic upper case portion, and a permanent magnet. Inside the terminal case, there are provided irregular-shaped guide portions for disposing nonreciprocal circuit components such as the center electrode assembly, at a predetermined position, and more specifically, a window portion, recesses for capacitors, and a bank portion for permanent magnet. These guide portions have tapered side wall surfaces each having a predetermined taper angle θ.

9 Claims, 7 Drawing Sheets

NONRECIPROCAL CIRCUIT DEVICE WITH TAPERED SIDE WALL GUIDE PORTIONS IN THE RESIN CASE

BACKGROUND OF THE INVENTION

1. Field of the Invention

The present invention relates to a nonreciprocal circuit device, and more particularly, to a nonreciprocal circuit device such as an isolator or a circulator used in a microwave band. The present invention further relates to a communication apparatus using this nonreciprocal circuit device.

2. Description of the Related Art

Generally, a lumped-constant type isolator used for mobile communication equipment such as portable telephones performs the function of passing signals only in the transmission direction, and of blocking the transmission thereof in the opposite direction. In recent years, mobile communication equipment is in an increasing demand for cost reduction, as well as that for the reduction in size and weight, because of its use. Correspondingly, the isolator is also required to be reduced in size, weight, and cost.

As such a lumped-constant type isolator, an isolator is shown in FIG. 9. In this lumped-constant type isolator 11, a resin terminal case 13 is disposed on a metallic lower case portion 12, which has left and right side walls 12*a* and a bottom wall 12*b*, and a center electrode assembly 14 is accommodated in this terminal case 13. A metallic upper case portion 15 is placed on the metallic lower case portion 12. A permanent magnet 16 is stuck on the inner surface of the metallic upper case portion 15, and it applies a DC magnetic field to the center electrode assembly 14.

In the center electrode assembly 14, three center electrodes 21 to 23 are arranged on the top surface of the microwave ferrite 20 so as to intersect each other at an angle of substantially 120 degrees, in an electrical insulation state. In these center electrodes 21 to 23, port portions P1 to P3 on one end sides thereof are led out horizontally, and a shield portion on the other end side which is common to the center electrodes 21 to 23, is abutted against the bottom surface of the ferrite 20. The common shield portion substantially covers the entire bottom surface of the ferrite 20, and is connected to the bottom wall 12*b* of the lower case portion 12, through a window portion 13*a* of the terminal case 13.

The port portions P1 to P3 of the center electrodes 21 to 23 are connected to the hot-side capacitor electrodes of the matching capacitors C1 to C3, respectively. On end of a terminating resistor R is connected to the hot-side capacitor electrode of the matching capacitor 3. The center electrode assembly 14, capacitors C1 to C3, etc. are accommodated in the terminal case 13.

Meanwhile, the terminal case 13 of the isolator 11 is provided with guide portions (the window portion 13*a* and the recess 13*b* shown in FIG. 10 correspond to these), in order to position the center electrode assembly 14, the capacitors C1 to C3, etc. as built-in components, when accommodating them. However, in order to assemble the isolator 11 utilizing an automatic assembling machine, it is necessary to ensure a clearance not smaller than 0.1 mm between the center electrode assembly 14 and the window portion 13*a*, or between the capacitor C3 and the recess 13*b*, by increasing the dimensions of the window portion 13*a* and the recess 13*b*. This raises a problem, however, that the position of each of the center electrode assembly 14 and the capacitor C3 varies by the amount of the clearance thereof, so that the electrical characteristics of the isolator 11 vary.

SUMMARY OF THE INVENTION

Accordingly, it is an object of the present invention to provide a nonreciprocal circuit device which can be assembled by an automatic assembling machine, and in which the built-in components thereof can be disposed with a high positioning accuracy, and to provide a communication apparatus using this nonreciprocal circuit device.

In order to achieve the above-described object, the present invention provides a nonreciprocal circuit in which guide portions for positioning the nonreciprocal circuit components with respect to the resin case are provided, and the guide portions have tapered side wall surfaces. Herein, it is preferable that the taper angle of each of the side wall surfaces be not more than 60 degrees. Particularly, by setting the taper angle of each of the side wall surfaces to be not more than 10 degrees, the miniaturization of the nonreciprocal circuit device can be achieved. Here, the nonreciprocal circuit components include, for example, a permanent magnet, a center electrode assembly, matching capacitors, a circuit board comprising a plurality of matching capacitors, and a terminator.

By this construction, since the guide portions are provided with tapered side wall surfaces, it is possible to widen the opening on the component-insertion side of each of the guide portions, and to facilitate the work of assembling nonreciprocal circuit components into the resin case by utilizing the automatic assembling machine. The nonreciprocal circuit components inserted into the guide portions are disposed at predetermined positions with a high positioning accuracy, while being subjected to the correction of positions thereof by the tapered side wall surfaces. Furthermore, by providing notches for center electrodes on the guide portion in which the center electrode assembly is provided, the displacement of the center electrode assembly due to a rotation can also be avoided.

Moreover, the communication apparatus in accordance with the present invention provides superior frequency characteristics by comprising a nonreciprocal circuit device having the above-described features.

The above and other objects, features, and advantages of the present invention will be clear from the following detailed description of the preferred embodiments of the invention in conjunction with the accompanying drawings.

DESCRIPTION OF THE PREFERRED EMBODIMENTS

Figure 1:
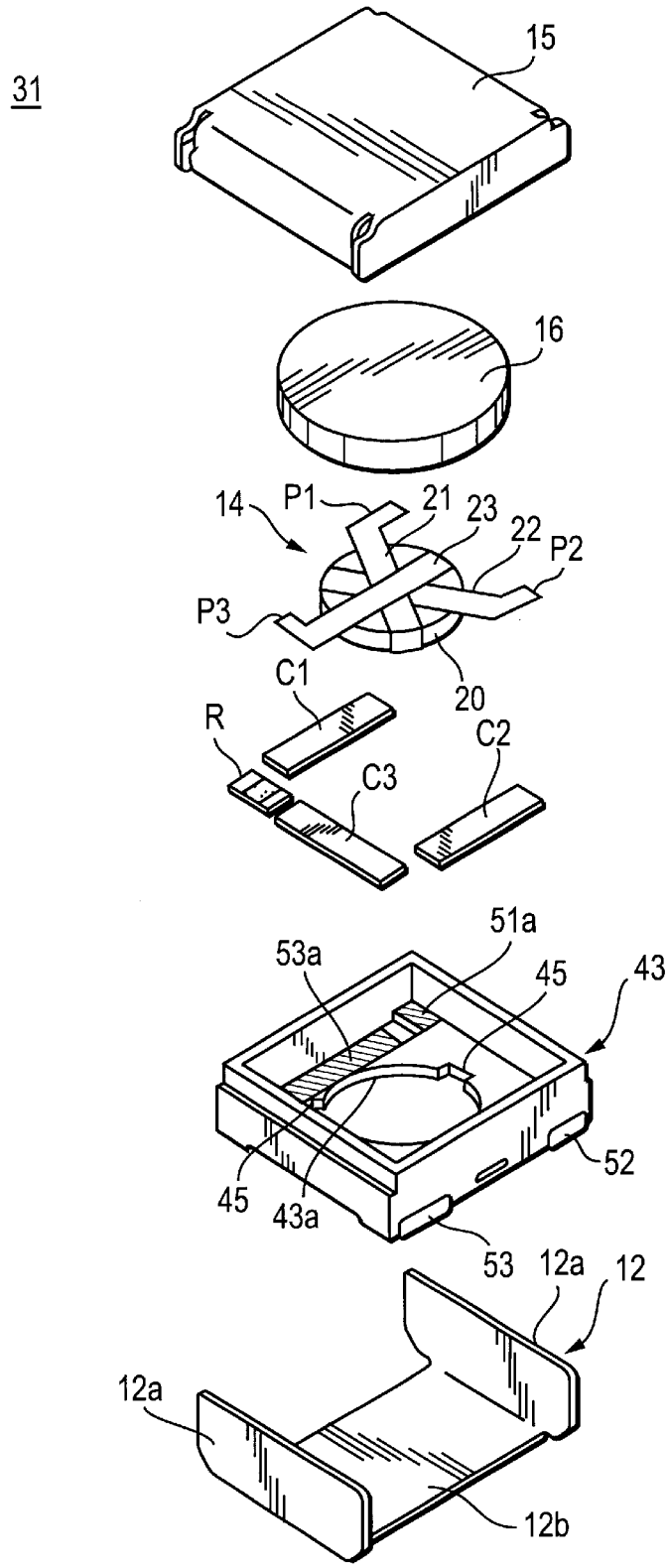
FIG. 1 is an exploded perspective view illustrating an embodiment of a nonreciprocal circuit device in accordance with the present invention.
Figure 9:
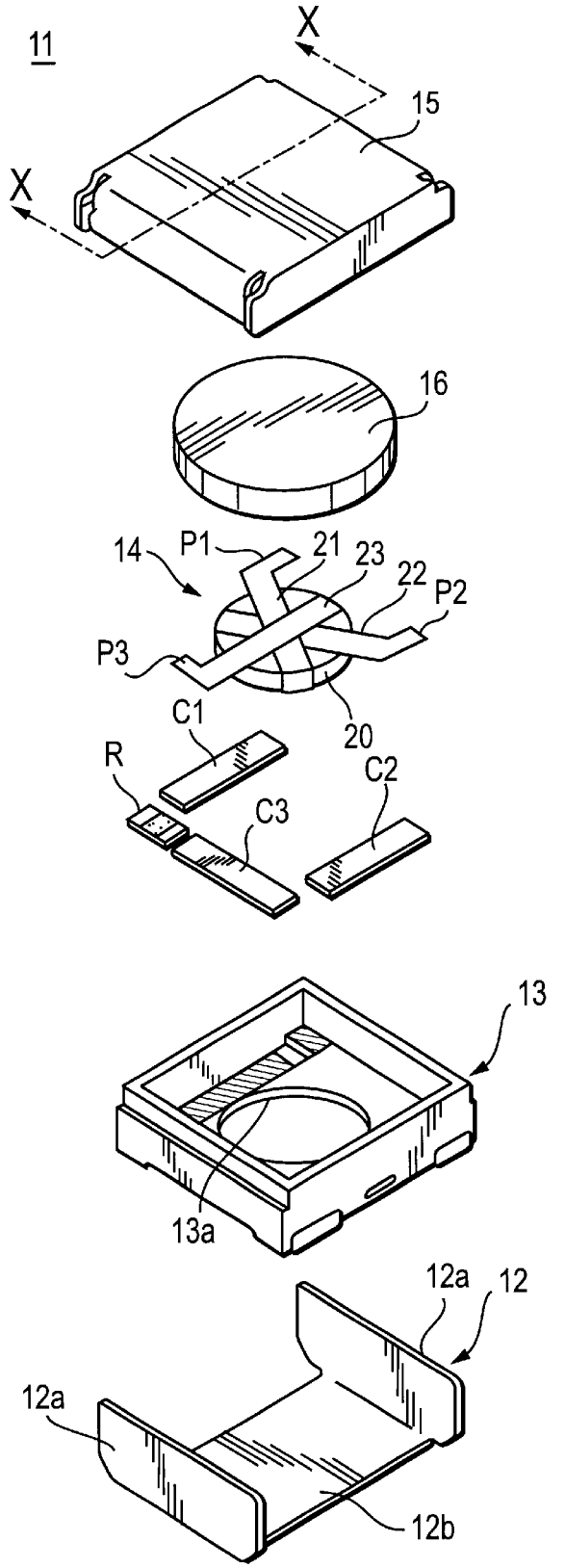
FIG. 9 PRIOR ART
FIG. 9 is an exploded perspective view illustrating a conventional nonreciprocal circuit device.
Figure 10:
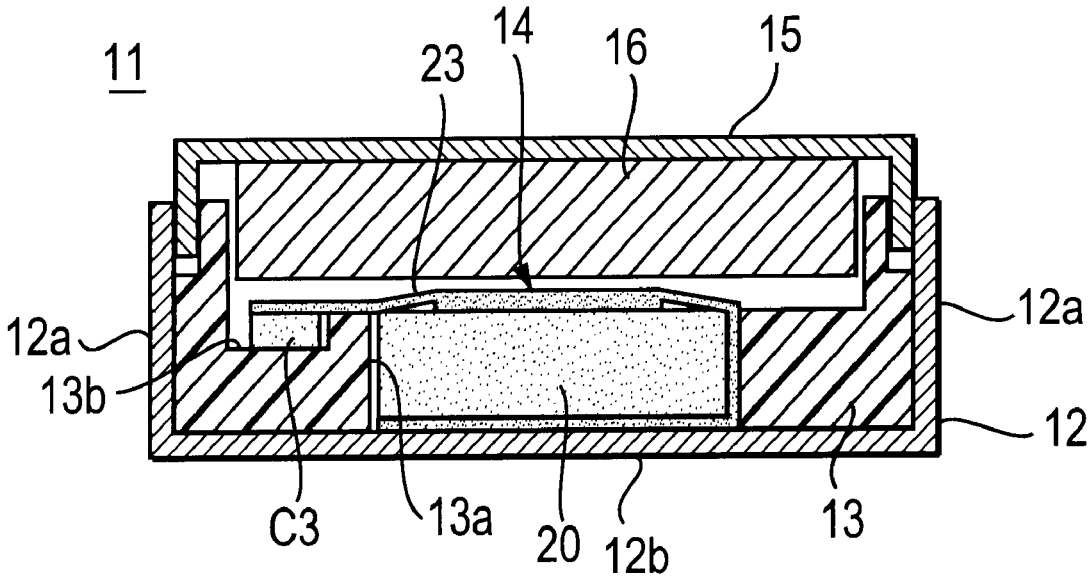
FIG. 10 PRIOR ART
FIG. 10 is a cross-sectional view taken along a line X—X in FIG. 9.

FIG. 1 is an exploded perspective view illustrating the construction of an embodiment of a nonreciprocal circuit device in accordance with the present invention. This lumped-constant type isolator 31 is formed by applying the present invention to the lumped-constant type isolator 11 which has been described with reference to FIG. 9. As shown in FIG. 1, the lumped-constant type isolator 31 comprises a metallic lower case portion 12, a resin terminal case 43, a center electrode assembly 14, a metallic upper case portion 15, and a permanent magnet 16.

In the center electrode assembly 14, three center electrodes 21 to 23 are disposed on the top surface (this is a first main surface and is one magnetic pole surface) of a microwave ferrite 20 having a block-shape so as to intersect each other at an angle of substantially 120 degrees, in an electrical insulation state. These center electrodes 21 to 23 have port portions P1 to P3 on one end thereof, which are led out horizontally, and the center electrodes 21 to 23 have a common shield portion on the other end thereof, which is abutted against the bottom surface (this is a second main surface and is the other magnetic pole surface) of the ferrite 20. The common shield portion substantially covers the entire bottom surface of the ferrite 20, and is connected to the bottom wall 12*b* of the metallic lower case portion 12, which will be described later, through a window portion 43*a* of the terminal case 43.

Figure 2:
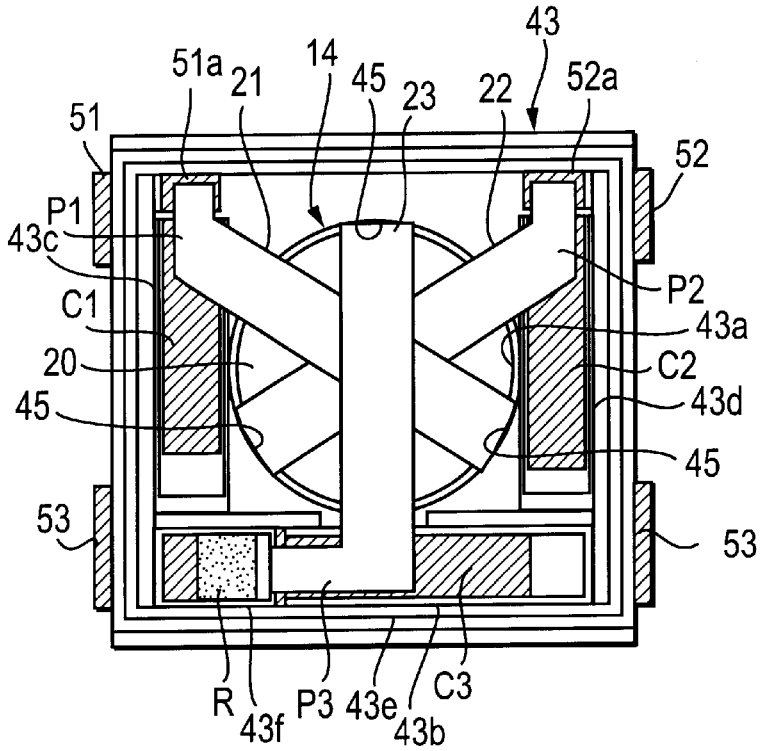
FIG. 2 is a plan view illustrating a center electrode assembly of the nonreciprocal circuit device shown in FIG. 1.

As shown in FIG. 2, input/output terminals 51 and 52, and ground terminals 53 are insert-molded to the terminal case 43. The input/output terminals 51 and 52 form input/output connection electrode portion 51*a* and 52*a*, respectively, by exposing one side ends thereof to the outside walls of the case 43, and by exposing the other ends thereof to the inside walls of the case 43. Likewise, the ground terminals 53 form ground connection electrode portion 53*a* (see FIG. 1), by exposing two ends thereof to the opposed outside walls of the case 43 and by exposing the remaining end to the inside wall.

Figure 4:
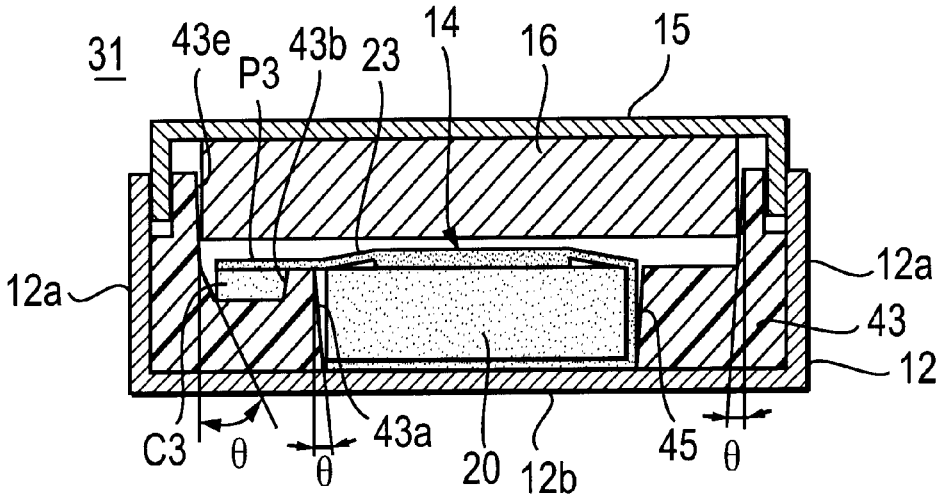
FIG. 4 is a cross-sectional view taken along a line IV—IV in FIG. 3.
Figure 5:
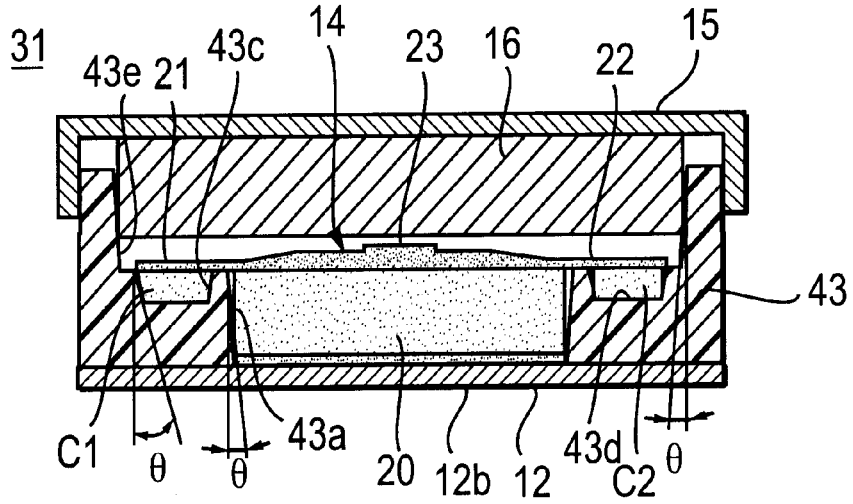
FIG. 5 is a cross-sectional view taken along a line V—V in FIG. 3.

Inside the terminal case 43, there are provided guide portions for disposing nonreciprocal circuit components such as the center electrode assembly 14 at predetermined positions, and more specifically, the window portion 43*a* and recesses 43*b* to 43*d* for capacitors, which are shown in FIGS. 4 and 5, a recess 43*f* for terminator (see FIG. 2), and a bank portion 43*e* for permanent magnet. These guide portions 43*a* to 43*f* have tapered side wall surfaces each having a predetermined taper angle θ (see FIGS. 4 and 5). In addition, on the side wall surface of the window portion 43*a*, notches 45 for center electrodes in which each of the center electrodes 21 to 23 of the center electrode assembly 14 is partly fitted, are provided substantially at every 120 degrees.

In matching capacitors C1 to C3, the hot-side capacitor electrodes thereof are soldered to the port portions P1 to P3, respectively, while the cold-side capacitor electrodes thereof are each soldered to the ground connection electrode portions 53*a* which are exposed to the inside wall surface of the terminal case 43. One end of a terminating resistance R is connected to the hot-side capacitor electrode of the matching capacitor C3, and the other end thereof is connected to the ground connection electrode portion 53*a*. That is, the matching capacitor C3 and the terminating resistance R are connected in parallel between the port portion P3 of the center electrode 23 and the ground.

The metallic lower case portion 12 is constituted of a magnetic metal, and has left and right side walls 12*a* and bottom wall 12*b*. On the metallic lower case portion 12, the resin terminal case 43 is disposed, and this resin terminal case 43 accommodates the center electrode assembly 14, the matching capacitors C1 to C3, etc. The metallic upper case portion 15 constituted of a magnetic metal is placed on the metallic lower case portion 12. The permanent magnet 16 is stuck on the bottom surface of the metallic upper case portion 15, and it applies a DC magnetic field to the center electrode assembly 14. The lower and upper case portions 12 and 15 form a magnetic circuit, and they also perform the function of a yoke. The case portions 12 and 15 are formed by stamping and bending a plate material constituted of a high-permeability metal such as iron or silicon steel, and the surface of the plate material is plated with copper or silver.

Figure 3:
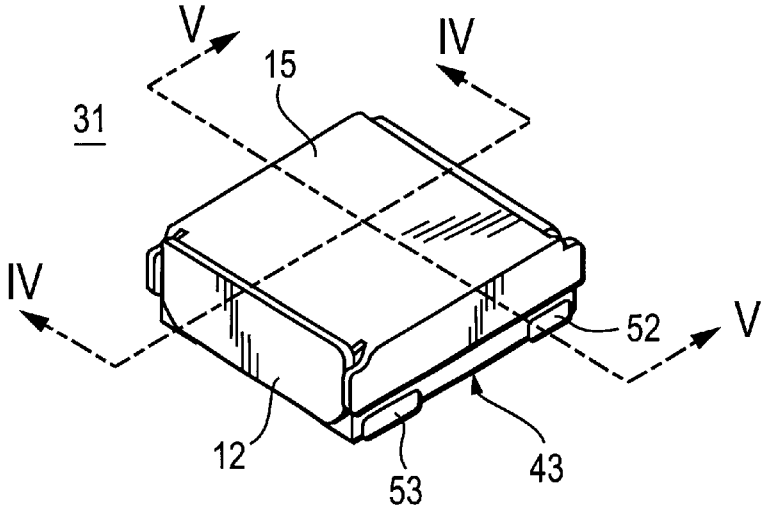
FIG. 3 is an external perspective view illustrating the nonreciprocal circuit device shown in FIG. 1.
Figure 6:
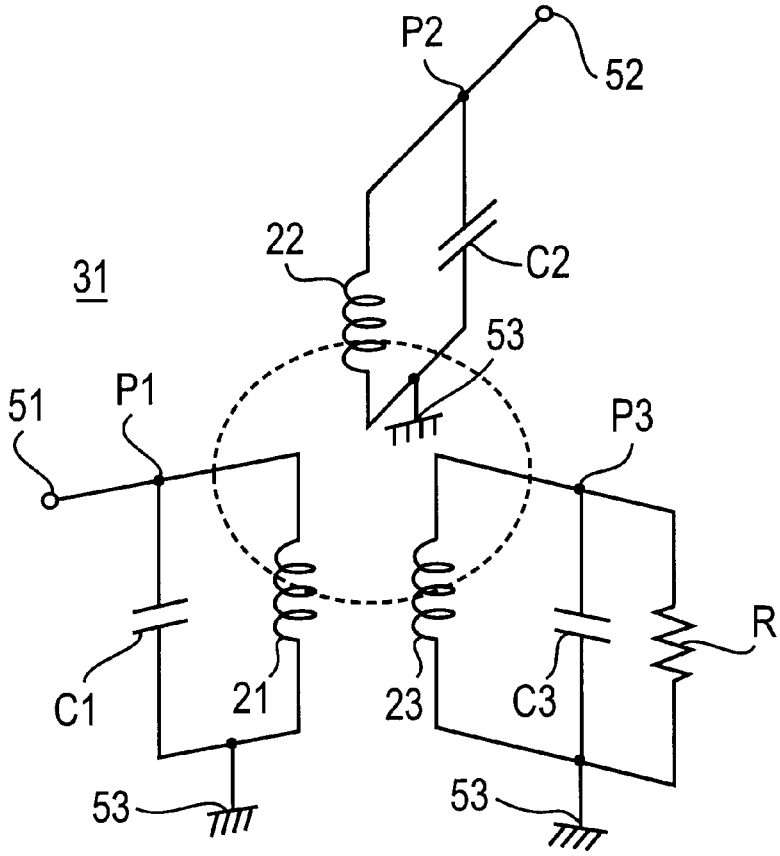
FIG. 6 is an electrical equivalent circuit diagram for the nonreciprocal circuit device shown in FIG. 1.

In this way, a lumped-constant type isolator 31 as shown in FIG. 3 is obtained. FIG. 6 is an electrical equivalent circuit diagram for the isolator 31.

In this isolator 31, since the guide portions 43*a* to 43*f* in the terminal case 43 have tapered side wall surfaces, the opening on the component-insertion side of each of the guide portions 43*a* to 43*f* can be made wider. This facilitates the work of assembling nonreciprocal circuit components into the terminal case 43 by utilizing the automatic assembling machine, that is, the work of inserting the center electrode assembly 14 into the window portion 43*a*, the work of inserting the matching capacitors C1 to C3 into the recesses 43*c*, 43*d*, and 43*b* for capacitors, respectively, the work of inserting the terminating resistor R into the recess 43*f* for terminating resistor, and the work of inserting the permanent magnet 16 into the bank portion 43*e* for permanent magnet. The nonreciprocal circuit components 14, C1 to C3, R, and 16 which have been inserted into the guide portions 43*a* to 43*f* are disposed at predetermined positions with a high positioning accuracy, while the longitudinal and lateral positions thereof are subjected to the correction by the tapered side wall surfaces. At this time, it is preferable that the taper angle θ of each of the side wall surfaces of the guide portions 43*a* to 43*f* be set to be not more than 60 degrees. This is because the advantage of position correcting decreases if the taper angle θ exceeds 60 degrees. Furthermore, when the size-reduction of the isolator 31 is conducted, the wall thickness enough to provide a taper to each of the side wall surfaces of the guide portions 43*a* to 43*f* cannot be ensured. Therefore, by setting the taper angle θ to be not more than 10 degrees, the compatibility between the size-reduction of the isolator and the taper formation on the side wall surfaces is secured.

The side wall surface of the window portion 43*a* is further provided with the notches 45 for center electrodes in which each of the center electrodes 21 to 23 of the center electrode assembly 14 is partly fitted. The above-mentioned tapered side wall surfaces and these notches 45 prevent the displacement of the center electrode assembly 14 in the longitudinal and lateral directions and the displacement by rotation thereof. As a result, an isolator 31 which is producible at a low cost and low in variations in electrical characteristics, is achieved.

Figure 7:
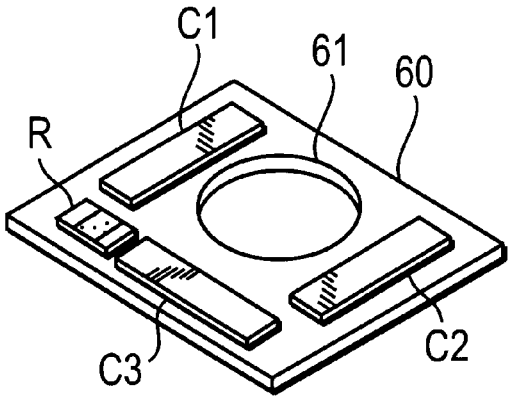
FIG. 7 is a perspective view illustrating a modification of the nonreciprocal circuit device shown in FIG. 1.

The number of assembling work may be reduced, by using a circuit board 60 on which matching capacitors C1 to C3 and a terminating resistor R are mounted as shown in FIG. 7, or by using a circuit board in which capacitor electrodes are formed on the surface of a dielectric substrate and which has the function of matching capacitors, to reduce the number of built-in components. Here, a hole 61 provided in the substantially central portion of the circuit board 60 is a hole used for inserting the center electrode assembly 14 therethrough.

A second embodiment as a communication apparatus in accordance with the present invention will be described taking a portable telephone as an example.

Figure 8:
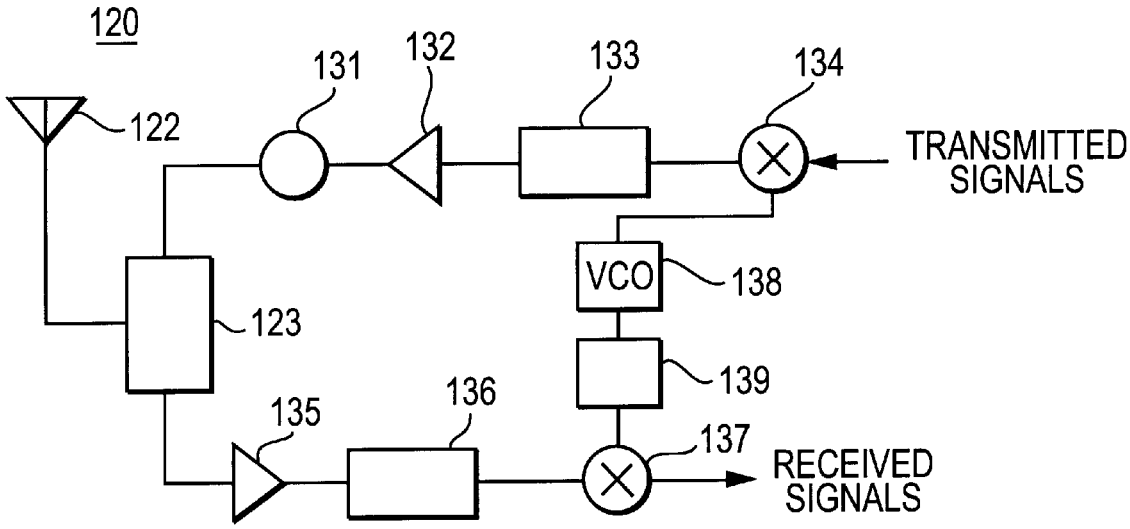
FIG. 8 is a bock diagram illustrating an embodiment of a communication apparatus in accordance with the present invention.

FIG. 8 is a bock diagram illustrating an electrical circuit in the RF portion of a portable telephone 120. In FIG. 8, reference numeral 122 designates an antenna device, 123 a duplexer, 131 a transmitting-side isolator, 132 a transmitting-side amplifier, 133 a transmitting-side interstage band-pass filter, 134 a transmitting-side mixer, 135 a receiving-side amplifier, 136 a receiving-side interstage band-pass filter, 137 a receiving-side mixer, 138 a voltage-controlled oscillator (VCO), and 139 a local band-pass filter.

Herein, as the transmitting-side isolator 131, a lumped-constant type isolator 31 in accordance with the above-described first embodiment can be used. By mounting this isolator 31, a portable telephone which has a high communication characteristics can be implemented.

The nonreciprocal circuit device and the communication apparatus in accordance with the present invention are not limited to the above-described embodiments, but may be variously modified.

In the above-described first embodiment, the entire surface of each of the side walls of the guide portions such as the window portion 43*a* and the recesses 43*b* to 43*d* for capacitors is inclined, but the entire surface thereof does not necessarily require inclination. For example, guide portions in each of which only the portion on the component-insertion side thereof is inclined, that is, guide portions subjected to so-called chamfering may instead be employed.

The present invention can also be applied to nonreciprocal circuit devices which are adopted into other high-frequency components such as circulators, apart from isolator. Furthermore, the center electrode can also be formed by providing a pattern electrode on a substrate (dielectric substrate, magnetic substrate, laminated substrate, or the like), apart from the center electrode which is formed by stamping a metallic plate and by bending the stamped plate.

As is evident from the foregoing, in accordance with the present invention, since the guide portions in the resin case have tapered side wall surfaces, the work of building nonreciprocal circuit components into the resin case utilizing the automatic assembling machine is facilitated, and also the nonreciprocal circuit components can be disposed on the resin case with a high positioning accuracy. As a result, an isolator 31 which is producible at a low cost and low in variations in electrical characteristics, can be achieved. Moreover, by reducing the taper angle in each of the guide portions in the resin case, the miniaturization of the nonreciprocal circuit device can be realized.

While the present invention has been described with reference to what are at present considered to be the preferred embodiments, it is to be understood that various changes and modifications may be made thereto without departing from the invention in its broader aspects, and therefore, it is intended that the appended claims cover all such changes and modifications as fall within the true spirit and scope of the invention.

What is claimed is:

1. A nonreciprocal circuit device, comprising:

nonreciprocal circuit components;

a resin case for accommodating said nonreciprocal circuit components;

guide portions provided in said resin case for positioning said nonreciprocal circuit components with respect to said resin case; and said guide portions have tapered side wall surfaces.

2. A nonreciprocal circuit device in accordance with claim 1, wherein said nonreciprocal circuit components comprising:

a permanent magnet; and a center electrode assembly comprising a ferrite including a plurality of center electrodes, said ferrite to which a DC magnetic field is applied by said permanent magnet.

3. A nonreciprocal circuit device in accordance with claim 2, wherein said nonreciprocal circuit components further comprising:

a plurality of matching capacitors which are electrically connected to said plurality of center electrodes, respectively.

4. A nonreciprocal circuit device in accordance with claim 2, wherein said nonreciprocal circuit components further comprising:

a circuit board provided with a plurality of matching capacitors which are electrically connected to said plurality of center electrodes, respectively.

5. A nonreciprocal circuit device in accordance with any one of claims 2 through 4, wherein said nonreciprocal circuit components further comprising:

a terminator which is electrically connected to one of said center electrodes.

6. A nonreciprocal circuit device in accordance with any one of claims 2 through 4, further comprising:

notches for center electrodes provided at the guide portion in which said center electrode assembly is positioned.

7. A nonreciprocal circuit device in accordance with any one of claims 1 through 4, wherein said guide portions have tapered side walls each having a taper angle not more than 60 degrees.

8. A nonreciprocal circuit device in accordance with any one of claims 1 through 4, wherein said guide portions have tapered side walls each having a taper angle not more than 10 degrees.

9. A communication apparatus provided with a nonreciprocal circuit device in accordance with any one of claims 1 through 4.

* * * * *